US007395635B2

(12) United States Patent
Neef et al.

(10) Patent No.: US 7,395,635 B2
(45) Date of Patent: Jul. 8, 2008

(54) DEVICE FOR LIFTING CONCRETE PARTS

(75) Inventors: Christoph Neef, Illerbeuren (DE); Matthias Kintscher, Memmingen-Eisenburg (DE)

(73) Assignee: Pfeifer Holding GmbH & Co. KG, Memmingen (DE)

( * ) Notice: Subject to any disclaimer, the term of this patent is extended or adjusted under 35 U.S.C. 154(b) by 214 days.

(21) Appl. No.: 10/879,342

(22) Filed: Jun. 28, 2004

(65) Prior Publication Data

US 2005/0257445 A1 Nov. 24, 2005

(30) Foreign Application Priority Data

May 10, 2004 (DE) ..... 20 2004 007 467 U

(51) Int. Cl.
*E04B 1/41* (2006.01)
*E04G 21/12* (2006.01)

(52) U.S. Cl. ..... 52/125.4; 52/124.2

(58) Field of Classification Search ..... 52/125.1, 52/124.2, 125.4, 125.6, 125.5; 294/89
See application file for complete search history.

(56) References Cited

U.S. PATENT DOCUMENTS

| | | | | |
|---|---|---|---|---|
| 4,304,431 | A | 12/1981 | Walston | |
| 4,443,980 | A * | 4/1984 | Pennypacker | 52/125.4 |
| 6,102,607 | A * | 8/2000 | Kintscher | 403/291 |
| 6,279,274 | B1 * | 8/2001 | Amiet et al. | 52/125.2 |
| 6,431,508 | B1 * | 8/2002 | Courson et al. | 248/205.3 |
| 6,688,049 | B2 * | 2/2004 | Sanftleben et al. | 52/125.4 |
| 7,137,609 | B2 * | 11/2006 | Sack | 249/91 |
| 2003/0140576 | A1 | 7/2003 | Sanftleben | |

FOREIGN PATENT DOCUMENTS

| | | | |
|---|---|---|---|
| CH | 688239 | A5 | 6/1997 |
| DE | 1684254 | | 5/1971 |
| DE | 3127087 | A1 | 1/1983 |
| DE | 3541262 | A1 | 6/1986 |
| DE | 4109706 | A1 | 11/1991 |
| DE | 29513732 | U1 | 10/1995 |
| DE | 29723990 | U1 | 10/1999 |
| EP | 0534474 | A2 | 3/1993 |
| EP | 0819203 | B2 | 10/1996 |
| EP | 0914531 | B1 | 1/1998 |
| WO | WO 96/31671 | | 10/1996 |
| WO | WO9631671 | * | 10/1996 |

* cited by examiner

*Primary Examiner*—Robert Canfield
*Assistant Examiner*—Christine T. Cajilig
(74) *Attorney, Agent, or Firm*—Wolf Greenfield & Sacks

(57) ABSTRACT

A device for attaching and lifting concrete parts, in particular reinforced concrete prefabricated elements, having a storage box and at least one flexible rope element which penetrates the storage box and has a rope loop and an end anchor, with the rope loop being at least partially accomodatable in the storage box and releasable thereform. At least one of the rope loop and the end anchor of the at least one flexible rope element assumes, at least in sections, an angle of between 0 and 45° to the bottom of the storage box.

20 Claims, 5 Drawing Sheets

DEVICE FOR LIFTING CONCRETE PARTS

TECHNICAL FIELD

The present invention relates to a device for attaching and lifting concrete parts, in particular reinforced concrete prefabricated elements, according to the preamble of claim 1.

PRIOR ART

Lifting anchors, which are embedded in a concrete element and subsequently form the contact point for a crane hook, lifting sling or the like, are typically used in the prior art for attaching and lifting concrete elements. Common lifting anchors have a head provided with an internal thread, which is accessible from the surface of the concrete in the embedded state of the lifting anchor. A lifting loop made of a steel wire rope and provided with an external thread is then screwed into the internal thread at the construction site, into which a crane hook can in turn be hooked (attached). Further known lifting anchors are disclosed, for example, in DE 295 13 732 U1 or DE 35 41 262 A1.

The known lifting anchors, however, have a number of disadvantages. For example, dirt often accumulates in the region of the threads, in particular due to concrete, which makes it considerably more difficult or even impossible to screw in a crane loop. There is furthermore the risk of crane loops being screwed into the internal thread which are not adapted to the lifting anchor or the weight of the precast concrete element, which considerably affects operational safety. Furthermore, crane loops left loose at the construction site often get lost and can easily be interchanged. It is furthermore difficult to fix the known lifting anchors to a formwork when manufacturing the precast concrete element.

A plurality of further inserts also exist in the building and construction industry. Connecting elements having a storage box for accommodating one or more steel wire rope loops are often used for the load-bearing connection of concrete parts. A storage box having a bent concrete reinforcing bar which protrudes from the bottom of the box at a right angle is shown, for example, in CH 688 239 A5. Shown in DE 3 127 087 A1 are also several bent concrete reinforcing steel elements, in which the straight element lies in the storage box and a loop protrudes at the concrete side orthogonally to the box bottom as the end anchor. DE 4 109 706 A1 also shows such a storage box having a bent concrete reinforcing bar and a loop protruding at a right angle as the end anchor. DE-OS 1 684 254 also shows a storage element containing a loop which is essentially stored in a folded state at a right angle to the end anchor and which is essentially vertical to the storage box bottom in the opened out state. It is characteristic of all these described storage boxes to accommodate rigid concrete reinforcing bars or also flexible wire rope elements in the storage box and to comprise an end anchor at the end which is essentially perpendicular to the storage box bottom. The purpose of these elements is respectively to join concrete sections together. Further examples of such storage boxes are disclosed in EP 0 534 474, EP 0 819 203 and EP 0 914 531.

It is common to all the storage boxes described above that their main function is to accommodate flexible reinforcement loops in the form of steel wire rope loops, which can be folded out following concreting so as to join the precast concrete element in a load-bearing and permanent manner by placing the precast concrete elements one against the other and overlapping the protruding loops. The main direction of action of the connecting rope loop is thus orthogonally to the bottom of the storage box in the end state. In the relaxed state, the ends of the anchor correspondingly protrude into the concrete at the concrete side perpendicularly to the storage box bottom. The direction of use of the loop which is folded during concreting and later protrudes in the relaxed state is perpendicular to the lengthwise direction of the box or to the bottom of the box. For this reason, it is common to all these storage boxes that retaining elements and devices have to be provided which force the rope loops into the folded position in a resiliently deforming manner. Only when they are unfolded can they reassume an unrestrained, relaxed position.

The known connecting elements with storage boxes thus require complicated auxiliary means which retain the rope loop in a deformed position inside the storage box before use, i.e. during embedding in concrete and transport. The storage box is provided, for example, with retaining elements for this purpose, which, however, makes construction of the connecting element complicated and expensive.

SUMMARY OF THE INVENTION

The object of the present invention is thus to provide a device for lifting concrete elements of the type described above, which has a simplified construction and increased operational safety.

This object is solved according to the invention by a device for attaching and lifting concrete elements, in particular reinforced concrete prefabricated elements, having a storage box and at least one flexible rope element which penetrates the storage box and has a rope loop and an end anchor, with the rope loop being at least partially accomodatable in the storage box and releasable thereform, characterised in that at least one of the rope loop and the end anchor of the at least one flexible rope element assumes, at least in sections, an angle of between 0 and 45° to the bottom of the storage box.

The concept of the present invention is to design a device for attaching and lifting concrete parts, which is to be embedded in concrete, such that it can be safely hung directly onto a crane hook or the like without any further means or measures. For this purpose, it is provided according to the invention that a device comprising a storage box and a flexible rope element, known per se as a connecting element for structures, is designed such that it is suitable as a lifting device. To be more precise, the loop and/or the end anchor of the at least one flexible rope element assumes, according to the invention, an angle of between 0 and 45° to the bottom of the storage box, at least in sections.

This angle specification thereby relates to the relaxed or unstressed state of the loop and/or the end anchor, in which the flexible rope element penetrates the storage box without the flexible rope element being deformed or deflected by retaining elements or the like. The expressions rope loop and end anchor furthermore describe those sections of the flexible rope element which are situated on different sides of the storage box or the storage box bottom, with the end anchor being provided to come to rest in the concrete in the fitted state.

The device according to the invention makes it possible to avoid special elements which deform the flexible rope element for transport, storage or fitting purposes and which retain said rope element in a specific position, for example inside the storage box. The flexible rope element is rather provided from the outset such that it is possible to effect folding of the loop at an almost negligible angle to the end anchor, so that, for example a formed part on the bottom of the storage box can be used just for sealing and not, however, for the resilient deformation of the wire rope loop.

Furthermore, in accordance with the invention, the flexible rope element is already disposed from the outset in an alignment in which the greatest lifting forces act during attaching and lifting of the concrete part containing the device. Damaging kinks, twists and the like along the rope element are hereby prevented, which increases the safety and durability of the device according to the invention. A low force deflection must also simultaneously occur in the concrete. In view of the above, the device according to the invention is also suitable for narrow, thin-walled and/or hollow components.

Operational safety is furthermore increased by the device according to the invention since the possibility of carrying out hanging onto a crane hook or the like or attaching connecting pieces, as is required in the prior art, in an erroneous manner is eliminated.

Provision is made according to an embodiment of the invention for the rope loop and/or the end anchor to assume an angle of between 2 and 25°, at least in sections, to the bottom of the storage box, as a result of which the advantages cited above become more pronounced.

The ends of the at least one rope element are linked together in the region of the end anchor, preferably by means of a steel ferrule. This not only creates a stable rope element having good tensile strength, but also connecting the ends of the rope element in the region of the end anchor enables an improved anchoring and load-bearing behaviour of the end anchor.

Although the storage box can assume a plurality of shapes depending on the purpose, it is preferred according to an embodiment of the invention for the storage box to be an elongated body for accommodating the at least one rope loop. It has thereby proven to be advantageous with regard to a secure accommodation of the rope loop for the storage box to have a C- or U-shaped longitudinal section. These shapes make it particularly easy to hook a crane hook or the like onto the rope loop without considerable deflection of said rope loop, which accelerates the work process and increases safety.

In order to ensure a good position retention and a problem-free sealing of the device according to the invention during concreting (casting of the concrete), an embodiment of the invention provides for the at least one flexible rope element to penetrate the bottom of the storage box in the region of an opening that is preferably sealed by a formed part.

According to a further aspect, the present invention also provides a fixing element, by means of which the device can be attached to rod-like elements such as reinforcing bars or the like. The device according to the invention does not have to be hereby fixed exclusively to one formwork section, but can rather be fixed at a desired position before installation of a formwork or before attachment of a reinforcement cage to a formwork, without the further production process being obstructed. It is hereby particularly preferred for the fixing element to be configured such that the device can be hung onto rod-like elements, whereby further simplifying the production process.

Although the fixing element can have any shape and can be produced from any material, it is preferred according to an embodiment of the invention for the fixing element to be made of a bent wire part, a sheet metal part or a plastic part and/or to have a curved shape at least in sections.

Depending on the case of use, the fixing element can be configured integrally with the storage box or can also be an element separate herefrom. In the latter case, provision is made according to an embodiment of the invention for at least one accommodation section to be provided on the storage box for attaching a fixing element. This makes it possible for the device according to the invention to be combined, depending on the case of use, with a customised fixing element, without the device having to be altered each time. It is thereby particularly preferred for the at least one accommodation section to be formed by an opening, recess, indentation and/or a bent-out part in the storage box.

In order to enable accommodation of the at least one rope loop in the storage box and unfolding of said rope loop from the same, provision is made according to an embodiment of the invention for the storage box to have an opening on its side opposite to the bottom of the storage box. It is thereby further provided for the opening to be closed by means of a removable cover such that the rope loop is protected until use and furthermore does not undesirably protrude from the storage box. A comparatively thin-walled cover can hereby be used within the scope of the present invention since the flexible rope element only has to be deformed by a small amount from its relaxed position when moved into the position assumed inside the storage box. It has furthermore proven to be a simple and reliable solution to configure the removable cover as a self-adhesive foil.

Even if the aforementioned fixing element is provided, it can be expedient to attach the storage box additionally or exclusively to a formwork. For this purpose, the storage box comprises at least one nail hole according to a further development of the invention. It is thereby particularly preferred for at least two nail holes to be provided so as to prevent a twisting of the storage box in the fixed state.

Although the device according to the invention can be incorporated into a concrete element in any manner, a concrete part, in particular a reinforced concrete prefabricated element, is provided according to a preferred embodiment of the present invention, in which the device according to the invention is incorporated such that the rope loop and/or the end anchor assumes, at least in sections, an angle of between 0 and 45°, preferably between 5 and 25°, also to the adjacent component surface.

Further, it is to be noted that the features and embodiments mentioned above may according to the present invention be combined with each other, where possible.

DETAILED DESCRIPTION OF PREFERRED EMBODIMENTS

Preferred embodiments of the present invention are described in detail below, with reference being made to the accompanying figures. It is to be noted, however, that the present invention is not limited to the embodiments discussed below.

Figure 1A:
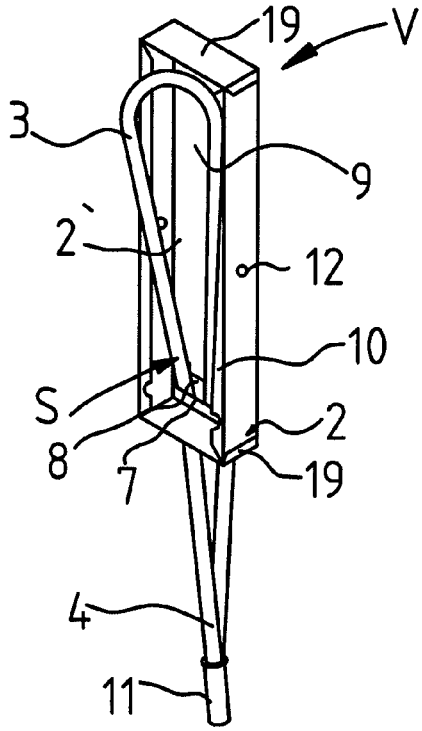
FIG. 1*a* shows a schematic perspective view of a first embodiment of the device according to the invention.

FIG. 1*a* shows a schematic perspective view of a first embodiment of the device V according to the invention which is provided to be cast into a concrete element 1 and to aid attachment and lifting of the concrete element 1 when the concrete is in the hardened state.

The device V according to the invention comprises a storage box 2 and, in the present embodiment, a flexible steel wire rope element S which penetrates the storage box in the region of an opening 7. The flexible rope element S comprises a rope loop 3 and, on the opposite side of the opening 7 and/or the storage box bottom 2', a so-called end anchor 4 in the form of the two end sections of the rope element which are linked together at their ends by means of a steel ferrule 4 or the like.

The flexible rope element can be, for example, a steel wire rope section, however the present invention is not restricted hereto and other flexible load-bearing elements can also be used. Due to its flexibility, the flexible rope loop 3 can be deflected by hand in relation to the storage box 2 and can thereby also be accommodated in a cavity formed by the storage box 2. In FIG. 1*a*, the flexible rope element S is shown in a relaxed, i.e. unstressed state, in which no external forces, except for possible deflection forces in the region of the through opening 7 and its own weight, act upon the flexible rope element S. In this state, the rope loop 3 and the end anchor 4 of the flexible rope element S each assume an angle in the range of between 5 and 25° to the storage box bottom 2'.

The storage box 2 is preferably integrally formed from a robust steel sheet as an elongated body, with it being possible to accommodate the rope loop 3 in the interior thereof. It has thereby proven to be advantageous to configure the storage box such that it has a C- or U-shape in the longitudinal section. A formed part 8 can be provided in the region of the opening 7 of the storage box bottom 2 in order to prevent the entry or escape of concrete or mortar. The ends of the storage box 2 are preferably formed from bent sheet metal and are folded such that they solidly close the storage box 2 as the end cover 19.

Figure 1B:
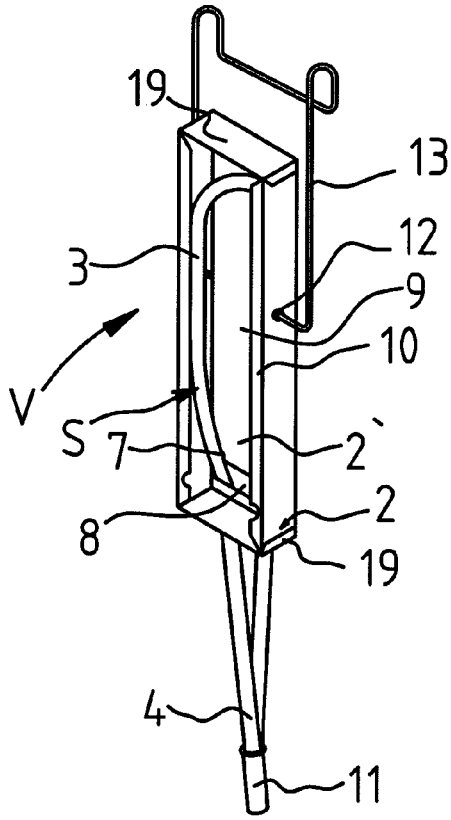
FIG. 1*b* shows a schematic perspective view of the device shown in FIG. 1*a* in conjunction with a fixing element.

A further development of the embodiment of FIG. 1*a* is shown as a schematic perspective view in FIG. 1*b*. The embodiment according to FIG. 1*b* additionally comprises a fixing element 13, by means of which the device can be attached to rod-like elements such as reinforcing bars or the like. Even though the fixing element 13 can also be integrally formed with the storage box 2, it is a separate component in the present embodiment, which is attached to or placed in accommodation sections 12 on the sidewalls of the storage box 2. The accommodation sections 12 of the storage box 2 can be openings, recesses, indentations and/or bent-out parts which enable easy attachment and, where necessary, release of the fixing element 13. The fixing element 13 can assume a plurality of shapes, but is, however, preferably configured such that it can be easily hung onto a rod-like element. Advantageous configurations of the fixing element 13 are, for example, a bent wire part, a sheet metal part or a plastic part, with it being preferred as regards hanging for the fixing element 13 to have a curved shape, at least in sections.

Figure 1C:
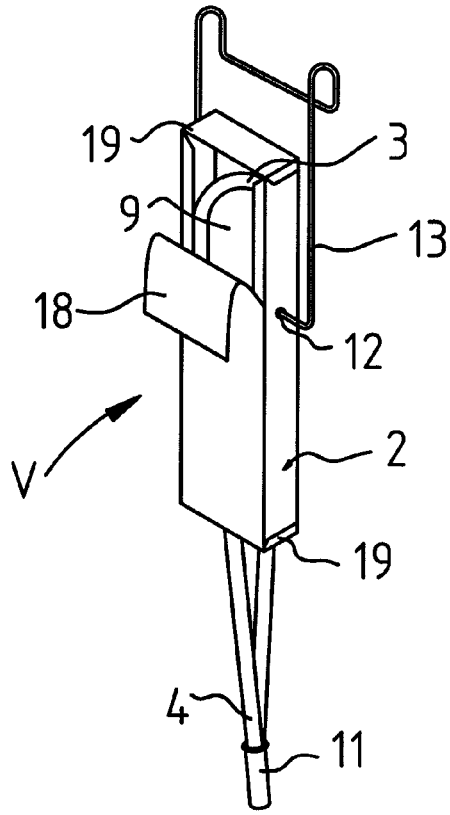
FIG. 1*c* shows a schematic perspective view of the device shown in FIG. 1*b* in conjunction with a cover.

A further embodiment of the device according to the invention is shown as a schematic perspective view in FIG. 1*c*. The device V shown in FIG. 1*c* corresponds to the embodiment of FIG. 1*b*, however it is additionally provided with a removable cover 18 which closes an opening 9 of the storage box 2 located opposite to the storage box bottom 2' of the storage box 2. The cover 18 is preferably made of a self-adhesive foil and ensures that no concrete or mortar enters the interior of the storage box 2 during a concreting process.

Figure 2:
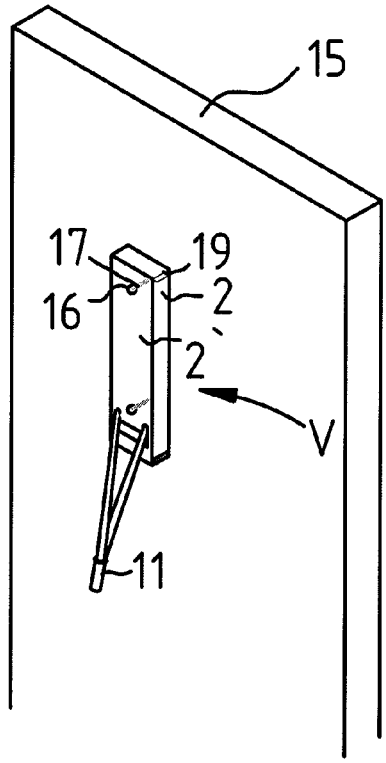
FIG. 2 schematically shows the attachment of the device from FIG. 1*a* to a formwork section.

Even though the Device V according to the present invention is preferably combined with at least one fixing element, the device V or the storage box 2 can also be alternatively or additionally directly attached to a formwork section, as is schematically shown in FIG. 2. The embodiment of the device V shown in FIG. 2 comprises two nail holes 17 for this purpose, through which nails can be driven into a wooden formwork section 15 to attach the storage box 2 itself to the same.

Figure 3:
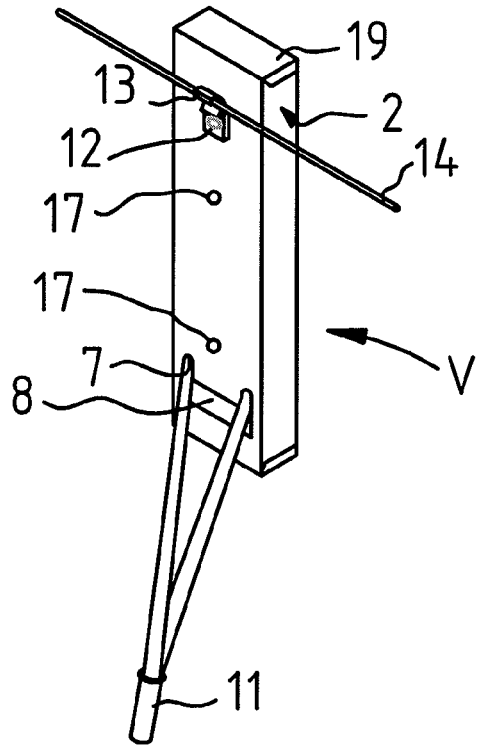
FIG. 3 schematically shows the attachment of a device according to the invention to a rod-like element.
Figure 4:
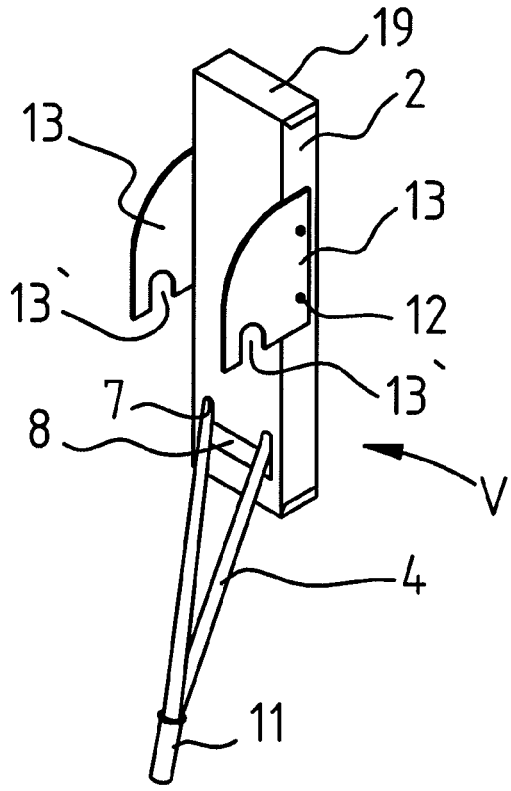
FIG. 4 schematically shows a further embodiment of the device according to the invention.

Schematic views of further embodiments of the device V according to the invention are shown in FIGS. 3 and 4. The embodiment in FIG. 3 is characterised in that the fixing element 13 is in the form of a short, curved hook made of a flat material, by means of which the device V can be hung onto a rod 14 in a problem-free manner. The alternative embodiment according to FIG. 4 is characterised by fixing elements 13 of a flat material which do not have to be bent, but rather in which the hanging function is achieved by means of clearances 13' in which a rod-like element can engage in a problem-free manner.

Figure 5:
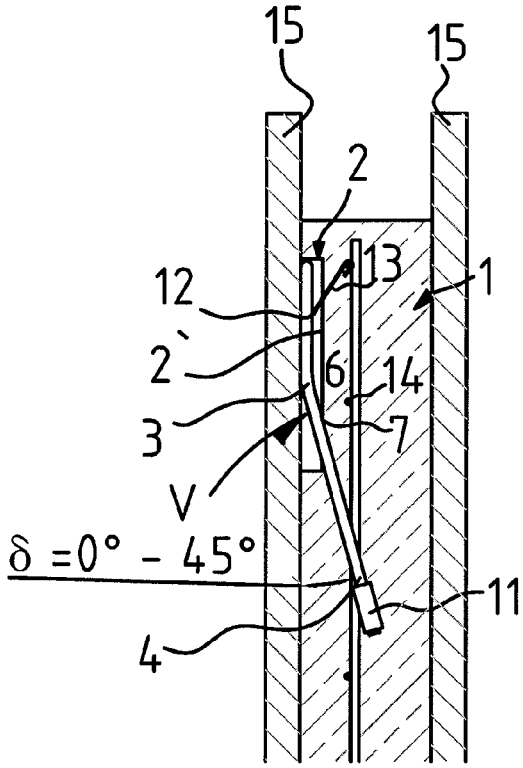
FIG. 5 shows a schematic side view of the integration of the device according to the invention in a concrete prefabricated element.

The integration of the device V according to the invention in a precast reinforced concrete element 1 which is still in the formwork 15, is shown as a schematic side view in FIG. 5. Therein, the rope loop 3 is located inside the storage box 2 so that it does not cause problems during production of the concrete prefabricated element 1 in the formwork section 15. Folding of the rope loop 3 into the interior of the storage box 2 can occur in any manner, for example by means of a foil cover, by means of side retaining elements or even by simply placing the storage box 2 on the formwork section 15. It is hereby advantageous that the rope loop 3 only has to be slightly deflected from its relaxed state as shown in FIG. 1*a* in order to enter the interior of the storage box 2.

The end anchor 4 of the flexible rope element S, however, has the alignment already shown in FIG. 1*a* in the integrated state and is thereby at a angle of between 0 to 45°, preferably between 5 and 25°, to the storage box bottom 2' at the concrete side 6. As can be seen in FIG. 5, this flat angle of the end anchor 4 has exactly the advantage, even in thin or slim components, that the ferrule 11 does not abut the opposite formwork section 15, but rather comes to rest freely in the reinforced concrete prefabricated element 1 such that even very narrow or slim components can be manufactured with the device V according to the invention without any problems and without any disturbances on the component surface or deformations of the end anchor 4.

Figure 6:
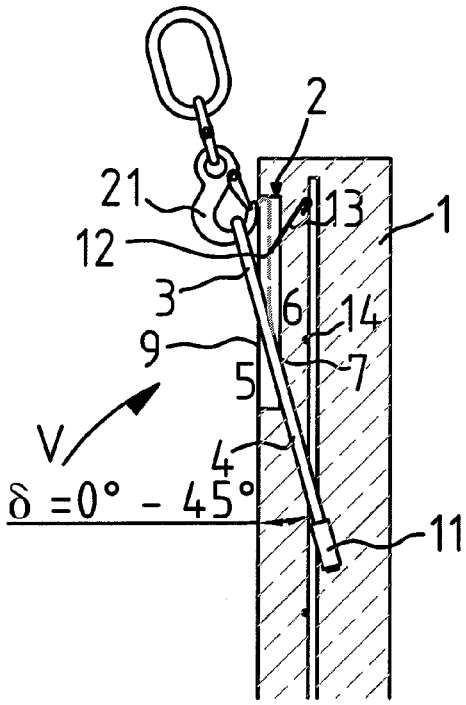
FIG. 6 shows a schematic side view of the attaching and lifting of a concrete prefabricated element by means of the device according to the invention.

The use of the device V according to the invention for lifting the precast concrete element 1 shown in FIG. 5 is schematically represented in FIG. 6. For this purpose, an optionally provided cover 18 is first of all removed from the storage box 2, whereupon the rope loop 3, provided that it is not retained by any further retaining elements, protrudes from the interior of the storage box 2 in the relaxed state shown in FIG. 1. The device V is thus already ready for attaching or hooking on a crane hook 20. Said crane hook or lifting sling hook now only has to be supplied and hooked on. The point of the hook can thereby enter the interior of the storage box 2, which considerably facilitates the hooking of the crane hook 20 onto the rope loop 3 and avoids sources of error. As is clear from FIG. 6, the rope loop 3 and the end anchor 4 are disposed in a direction in which a large part of the lifting force of the crane hook 20 also acts, which favourably influences the load-bearing behaviour during lifting and also makes it possible for thin, slim or hollow components to be safely lifted with the device according to the invention.

Figure 7:
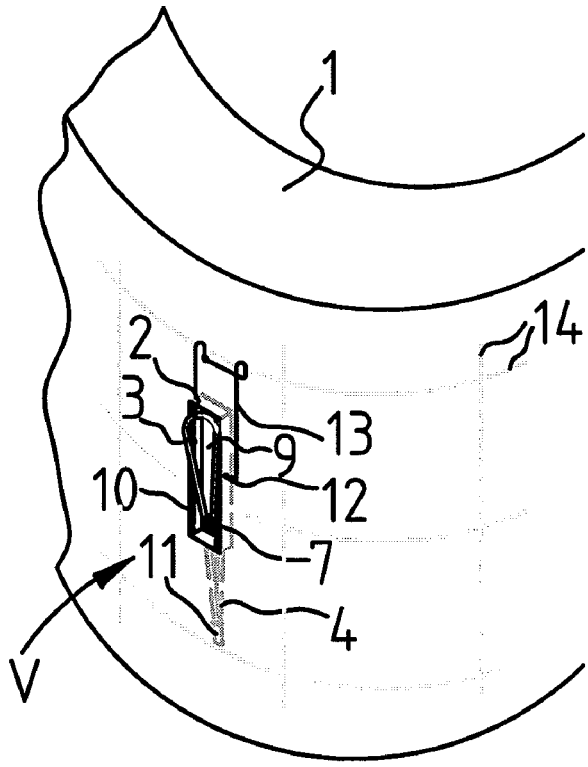
FIG. 7 shows a schematic, partially cut-away view of the integration of the device according to the invention in a curved, thin-walled concrete prefabricated element.

An example of a hollow concrete component often encountered is schematically shown in FIG. 7. Shown therein is a tube section 1, in the curved outer wall of which the device V according to the invention is hung by means of a fixing element 13. Such tube-like components 1 often have very low wall thickness and thus the use of known attaching devices is difficult for the most part, however the device V according to the invention enables a safe and problem-free lifting of the component 1.

Though the present invention has been described based on presently preferred embodiments, the skilled person will appreciate the various modifications and variation can be made without departing from the spirit and the scope of the invention as defined in the appended claims.

LIST OF REFERENCE NUMBERS

1 Precast Concrete element
2 Storage box
2' Storage box bottom
3 Wire rope loop
4 Rope anchor, end anchor
5 Formwork-side
6 Concrete-side
7 Opening, passage in the storage box
8 Formed part
9 Opening of the storage box
10 Retaining means or flanges
11 Ferrule
12 Retaining elements
13 Fixing means
14 Reinforcement
15 Formwork
16 Nail hole
17 Nail
18 Cover of the opening
19 End cover
20 Crane hook or lifting sling hook
δAngle of the end anchor to the plane of the storage box bottom
V Device
S Rope element

The invention claimed is:

1. A device for attaching and lifting concrete elements having a storage box with a bottom and an opening in the storage box opposite the bottom of the storage box and at least one flexible rope element which penetrates the storage box and has a rope loop and an end anchor, with the rope loop being at least partially accomodatable in the storage box and releasable therefrom through the opening in the storage box to an unrestrained configuration, wherein at least one of the rope loop and the end anchor of the at least one flexible rope element is configured to maintain, in its relaxed state, at least in sections, an angle of between 0 and 45° to the bottom of the storage box when in the unrestrained configuration.

2. The device according to claim 1, wherein at least one of the rope loop and the end anchor of the at least one flexible rope element assumes, at least in sections, an angle of between 5 and 25° to the bottom of the storage box.

3. The device according to claim 1, wherein the ends of the at least one rope element are linked together in the region of the end anchor, by means of a ferrule.

4. The device according to claim 1, wherein the storage box is an elongated body for accommodating the at least one rope element.

5. The device according to claim 1, wherein the storage box has a C- or U-shaped longitudinal section.

6. The device according to claim 1, wherein the at least one flexible rope element penetrates the storage box bottom in the region of an opening which is sealed by a formed part.

7. The device according to claim 1, wherein said device further comprises a fixing element, by means of which the device can be attached to, in particular hung on, rod-like elements.

8. The device according to claim 7, wherein the fixing element is made of a bent steel wire part, a sheet metal part or a plastic part and/or has a curved form, at least in sections.

9. The device according to claim 7, wherein at least one accommodation section, in particular an opening, recess, indentation and/or bent-out part, is provided on the storage box for attaching a fixing element.

10. The device according to claim 7, wherein the fixing element is integrally configured with the storage box.

11. The device according claim 1, wherein the top and bottom ends of the storage box are sealed by end covers.

12. The device according to claim 1, wherein the top and bottom ends of the storage box are integrally produced by bent sheet metal.

13. The device according to claim 1, wherein the opening in the storage box opposite the storage box bottom is closed by a removable cover.

14. The device according to claim 13, wherein the removable cover is configured as a self-adhesive foil.

15. The device according to claim 1, wherein the storage box comprises at least one nail hole, preferably at least two nail holes, for fixing the storage box to a formwork.

16. A concrete component comprising a device for attaching and lifting the concrete component, having a storage box with a bottom and an a opening in the storage box opposite the bottom of the storage box and at least one flexible rope element which penetrates through a second opening in the bottom of the storage box and has a rope loop and an end anchor, with the rope loop being at least partially accomodatable in the storage box and releasable therefrom through the opening in the storage box to an unrestrained configuration, wherein at least one of the rope loop and the end anchor of the at least one flexible rope element is configured to maintain, in its relaxed state, at least in sections, an angle of between 0 and 45° to the bottom of the storage box and to the adjacent component surface when in the unrestrained configuration.

17. The device according to claim 1, wherein the rope loop of the at least one flexible rope element is configured to maintain, in its relaxed state, at least in sections, an angle of between 0 and 45° to the bottom of the storage box when in the unrestrained configuration.

18. The device according to claim 1, wherein the end anchor of the at least one flexible rope element is configured to maintain, in its relaxed state, at least in sections, an angle of between 0 and 45° to the bottom of the storage box when in the unrestrained configuration.

19. The concrete component according to claim 16, wherein the rope loop of the at least one flexible rope element is configured to maintain, in its relaxed state, at least in sections, an angle of between 0 and 45° to the bottom of the storage box and to the adjacent component surface when in the unrestrained configuration.

20. The concrete component according to claim 16, wherein the end anchor of the at least one flexible rope element is configured to maintain, in its relaxed state, at least in sections, an angle of between 0 and 45° to the bottom of the storage box and to the adjacent component surface when in the unrestrained configuration.

* * * * *